United States Patent [19]

Jonnes

[11] Patent Number: 4,522,733

[45] Date of Patent: Jun. 11, 1985

[54] SUBSTANTIALLY NEUTRAL AQUEOUS LUBRICANT

[75] Inventor: Nelson Jonnes, Stillwater, Minn.

[73] Assignee: American Polywater Corporation, Stillwater, Minn.

[21] Appl. No.: 633,247

[22] Filed: Jul. 23, 1984

Related U.S. Application Data

[63] Continuation-in-part of Ser. No. 462,362, Jan. 31, 1983, Pat. No. 4,461,712.

[51] Int. Cl.[3] ..... C10M 3/04

[52] U.S. Cl. ..... 252/49.3; 72/42; 252/49.5; 252/51.5 A; 252/52 R

[58] Field of Search ..... 252/49.3, 49.5, 51.5 A, 252/52 A; 72/42

[56] References Cited

U.S. PATENT DOCUMENTS

| | | | |
|---|---|---|---|
| 3,336,225 | 8/1967 | Sayad et al. | 252/49.3 |
| 3,563,895 | 2/1971 | Janatka et al. | 252/49.3 |
| 4,378,299 | 3/1983 | Alexander | 252/51.5 A |
| 4,392,865 | 7/1983 | Grosse et al. | 252/49.3 |
| 4,461,712 | 7/1984 | Jonnes | 252/49.3 |

*Primary Examiner*—Jacqueline V. Howard

*Attorney, Agent, or Firm*—Merchant, Gould, Smith, Edell, Welter & Schmidt

[57] ABSTRACT

A substantially neutral aqueous lubricant comprising a major portion of water, a polyelectrolyte acrylate compound, a fatty acid compound, a polyacrylamide compound and a $C_{1-6}$ alcohol, methods to make the lubricant and methods of its use.

21 Claims, No Drawings

SUBSTANTIALLY NEUTRAL AQUEOUS LUBRICANT

This application is a continuation-in-part of Ser. No. 462,362 filed Jan. 31, 1983, which will issue as U.S. Pat. No. 4,461,712 on July 24, 1984.

Field of the Invention

The invention relates to aqueous gel lubricants used in a variety of applications such as the installation of electrical or telephone cable in conduit.

BACKGROUND OF THE INVENTION

In lubricating the interface between two relatively moving surfaces a number of requirements must be met. The lubricant must be essentially chemically and physically inert with respect to the surfaces. The lubricant must reduce the force required to move one surface over the other. Lastly the lubricant must be in a form that permits the easy application of the lubricant to one or both surfaces.

Historically, lubricants were first prepared by thickening natural fats and oils with clay or chalk in order to provide sufficient lubrication for primitive wheels and axles. Upon the advent of the petroleum industry lubricant oils and greases were prepared from heavy petroleum oil fractions. In many applications petroleum lubricants are undesirable. Petroleum lubricants can interact with many organic and inorganic substances such as plastics and rubbers, can be difficult to clean up after application, can remain in place well after application and can be unpleasant to workmen.

In view of the serious drawbacks that petroleum lubricants can have in certain applications, water based lubricants were developed. The use of many different water based lubricants is well known. More specifically, aqueous based compositions of high molecular weight polyalkylene oxide polymers have been prepared for a variety of applications including lubrication. Many other compounds have been used in preparing aqueous lubricants such as various fatty acid soaps, acrylate polymers, waxes, alkylene glycols, guar gum, Irish moss, carboxymethyl cellulose, phenolic and amine-formaldehyde resins, hydrocarbon sulfonic acids, gelatin, polyurethanes, and others. See for example U.S. Pat. Nos. 3,227,652 and 3,699,057. Aqueous based lubricants are commonly more easily cleaned, more easily applied and are more agreeable to use.

To the best of my knowledge aqueous based lubricants containing many of the above mentioned compounds can suffer certain disadvantages. The lubricant compositions can be stiff, can be nonthixotropic, can be hard to handle and apply to the surface, the lubricant can fail to reduce the coefficient of friction under a broad load range or can be expensive.

Clearly a need exists for an inexpensive substantially inert aqueous lubricant that can be easily handled, easily applied to surfaces, having a low coefficient of friction under heavy or light load.

BRIEF DISCUSSION OF THE INVENTION

I have found an inexpensive gel lubricant that has the ability to lubricate surfaces in contact under a variety of loads by reducing the coefficient of friction to an acceptable level. The lubricant has the advantages that it is an aqueous gel that is easy to apply and easily cleaned, provides lubrication under both high and low load condition, is essentially inert to most lubricated surfaces, leaves little residue upon evaporation of the liquid phase, is easy to handle, and is slow in evaporating. The gel is substantially freezethaw stable, is agreeable to workmen, can be pumped, has long-time shelf stability, is substantially nonflammable, and can be used in water filled conduit. The improved lubricant is an aqueous gel comprising a major proportion of water, an effective gelling amount of an acrylate polyelectrolyte compound, an effective lubricating amount of a fatty acid salt compound, an effective lubricating amount of a polyacrylamide compound, and an effective solubilizing, antioxidant preservative amount of a $C_{1-6}$ alkanol, wherein sufficient fatty acid salt compound is added to titrate the acrylate polyelectrolyte to substantial neutrality.

The preparation of the gel lubricant can be difficult. The solubilities of certain components can be low, the kinetics of solution formation can be slow, and the individual components can interact in ways that prevent the rapid formation, under certain conditions of a single phase composition or a stable suspension. Accordingly, we have found that the gelled lubricant of the invention is most advantageously prepared by first forming (1) an aqueous solution or suspension of the acrylate polyelectrolyte compound, (2) a solution or suspension of the fatty acid compound in a $C_{1-6}$ alcohol, and (3) a suspension of the polyacrylamide in water or in a $C_{1-6}$ alcohol, and second intimately combining each of the resulting compositions with mixing until the component parts have formed a stable, intimately blended, apparently single phase gel.

While I do not wish to be held to a theory of action of the gel preparation, it appears that titrating the acrylate polyelectrolyte compound with the basic salt of the fatty acid results in the formation of a stable gel without breaking the suspension of the fatty acid salt compound. We have found that at substantially more basic pH than neutrality, the gel tends to be loose, less thixotropic, and has reduced lubricant properties. At pH's substantially more acid than neutrality, the lubricant becomes more stiff and more difficult to handle. Accordingly, pH control during the formation of the lubricant compositions is critical in obtaining adequate lubricating properties.

DETAILED DESCRIPTION OF THE INVENTION ACRYLATE COMPOUND

Acrylate polyelectrolyte gelling compounds that can be used in forming the novel lubricant composition of the invention include polyelectrolyte polymers and copolymers having a molecular weight in excess of about 1,000, and preferably about 20,000 to 10,000,000.

The preferred polymers are derived from the polymerization of at least one polymerizable acrylate monomer having ethylenically unsaturated group and a hydrophilic acidic group, that can maintain an ionized electrical charge in solution, selected from the class consisting of carboxylic acid, carboxylic acid anhydride, carboxylic acid halide, or mixtures thereof. Preferred organic polymeric acrylate-type polymers are made from carboxylic acid containing monomers, forming polyelectrolyte organic polymers which are anionic in nature. Useful monomers include acrylic acid, acrylic acid esters and salts, methacrylic acid and methacrylic acid ester salts, alpha-beta unsaturated dicarboxylic anhydride compounds such as maleic anhydride, itaconic acid, citriconic acid, and others. Along with the acidic carboxyl containing monomer other monomers can be used in preparing the polymers which do not detract from the polyelectrolyte or carboxylic acid nature of the polymer. Such comonomers can include styrene, vinyl acetate, vinyl chloride, vinyl ethers, ethylene, isobutylene, and others.

The most preferred gelling agent comprises polyacrylic acid having a molecular weight of at least about 3,000, which comprises the following formulae:

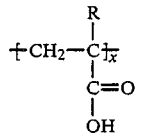

Polyacrylic acid polymers can be efficient gelling agents for aqueous solutions, are low in toxicity, do not increase frictional force and are compatible in aqueous solution with other components. Other conventional thickeners can be used with appropriate pH adjustment.

Polyacrylamide Compound

Polyacrylamide compounds that can be used in the novel gel lubricants of the invention are well known polymeric and copolymeric compounds formed by polymerizing an acrylamide-type monomer of the formula

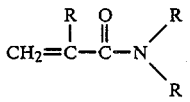

wherein R is independently a $C_{1-10}$ alkyl, such as acrylamide, propionic acid amide, methacrylamide (2-methyl-propionic acid amide), etc. Copolymers can be made by coplymerizing the acrylamide monomer with other acrylic monomers such as acrylic acid, methacrylic acid, methyl acrylate, methyl methacrylate, etc. Preferred polyacrylamide polymers are homopolymers of acrylamide, which compound has the following formula:

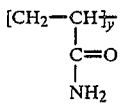

wherein y is $1\times10^3$ to $3\times10^5$. Copolymers of acrylamide and an acrylic or methacrylic monomer, having a molecular weight of about $1\times10^5$ to $10\times10^6$ are most preferred. The preferred polymers contain sufficient acrylic monomer to produce a low, medium or high anionic functionality from the pendant carboxyl groups. Polyacrylamide polymers can reduce friction at concentrations as little as 0.003%. Aqueous solution of polyacrylamide can produce significant reductions in frictional force needed to move surfaces past one another. Polyacrylamide polymers can provide lubricity and a "silky" feel to aqueous solution. Polyacrylamide polymers are tolerant of electrolytes, can be combined with many other types of compounds and have low toxicity.

Fatty Acid Salt Compounds

Basic salts formed from an alkali metal, alkaline earth metal, an organic amine or ammonia and aliphatic saturated or unsaturated fatty acid having from about 8 to 25 carbon atoms can be used in the novel aqueous gel lubricant of this invention. Examples of suitable acids include lauric acid, dodecenoic acid, myristic acid, myristoleic acid, palmitoleic acid, palmitic acid, stearic acid, oleic acid, linoleic acid, linolinic acid, arachidonic acid, behenic acid, lignoceric acid, eicosenoic acid, pentacosenioc acid and others. These acids can be derived from both natural and synthetic sources. Natural sources include animal and vegetable fats or oils which can be partially or fully hydrogenated if desired. Synthetic acids can be produced by the oxidation of petroluem wax, for example synthetic acids commercially available from Sun Oil Company. Preferred fatty acid compounds are the alkali metal salts of $C_{16-20}$ carboxylic acids. The most preferred fatty acid compound comprises the potassium salt of $C_{16-20}$ fatty acid which is commercially available as "FLAZOAP".

Hydroxy Compounds

Hydroxy compounds (hydroxy substituted aliphatic compounds) that can be used as a freezing point depressor, an antioxidant, a preservative, a solvating or suspending agents in preparing the lubricants of the invention include compounds having from 1 to 3 hydroxy groups and from 1 to 6 carbon atoms. The hydroxy compounds can be essentially straight or branched chain compounds. Examples of suitable hydroxy compounds include methanol, ethanol, ethylene glycol, propanol, isopropyl alcohol, propylene glycol, glycerine, n-butanol, isobutanol, tertiary butanol, amyl alcohol, isoamyl alcohol, n-hexanol, t-hexanol, cyclohexanol, etc. Preferred hydroxy compounds include methanol, ethanol isopropanol and propylene glycol. Most preferred hydroxy compounds are isopropanol and propylene glycol for reasons of availability and solvent power.

Formulation of Lubricant

The lubricant of the invention comprising a major portion of water, the acrylate polyelectrolyte compound, the fatty acid salt compound, the polyacrylamide compound, and the hydroxy compound requires some care in blending. While the lubricant of the invention can be prepared by blending the components in any order, the results can be unreliable. Blending the lubricant can take an inordinate amount of time and the components can interact or fail to solvate resulting in multiphase compositions. In other words, each of the individual components has its own particular solubility, solvation kinetics, and interaction chracteristics which can result in formulation problems. Further, the pH of the final composition must be closely controlled to insure success in formulation.

I have found a unique, successful method for combining the ingredients into a stable, apparently single phase composition that provides the desired lubricating characteristics. The method comprises first forming (1) a solution or suspension of the acrylate compound in water, (2) a solution or suspension of the fatty acid salt compound in water or in the hydroxy compound, (3) a solution or suspension of the polyacrylamide in the hydroxy compound and combining the above compositions with agitation resulting in a smooth, apparently single phase clean gel lubricant composition.

In order to form the aqueous acrylic polyelectrolyte compound suspension, about 0.1 to 50 parts by weight of the polyelectrolyte is blended with about 1,000 parts by weight of water and the resulting mixture is agitated until solution is complete. Preferably, for reasons of economy and lubricating performance, about 1 to 10 parts by weight of the polyelectrolyte compound is dissolved in 1,000 parts of water.

The solution of the fatty acid salt compound in water or hydroxy compound is formed by adding about 10 to 100 parts by weight of the fatty acid salt compound to about 10 parts of water or hydroxy compound and agitating the resulting mixture until solution is complete. For reasons of economy and optimized lubricating properties, about 10 to 50 parts of the fatty acid salt compound is used per 10 parts of water or hydroxy compound.

Similarly, the suspension of polyacrylamide polymer in hydroxy compound is prepared by adding about 1 to 10 parts of the polymer in a finely divided state to about 10 parts of hydroxy compound with vigorous stirring in order to form a slurry of the polyacrylamide. A preferred suspension contains about 1 to 5 parts of the polyacrylamide per 10 parts of hydroxy compound.

The acrylate solution, the fatty acid solution, and the polyacrylamide suspension are combined in a mixer at a volume ratio such that the final lubricant composition contains a major proportion of water, the acrylic polyelectrolyte polymer, about 1 to 10 parts by weight of the fatty acid compound, about 0.05 to 10 parts by weight of the polyacrylamide compound, about 0 to 30 parts by weight of hydroxy compound each per part of the acrylate polyelectrolyte compound and has a pH of about neutrality, preferably about 6.4 to 8.5. Additional water or hydroxy compound can be added until the lubricant composition comprises about 0.5 to 10 wt-% total solids and about 0 to 40 wt-% hydroxy compound, the balance being water and optionally emulsifying agents or suspending agents or other beneficial additives.

A preferred method for distributing the lubricant in a conduit and an article for providing an even distribution of the lubricant is disclosed in U.S. Ser. No. 445,469, filed Nov. 30, 1982.

The aqueous gel lubricant may be applied to surfaces requiring lubrication using various means such as hand application, flow coating, spraying, or by immersing the surface in the lubricant. In such applications lubricant temperature may vary widely from about −20° C. up to about 70° or80° C. Typical temperatures for application by immersion are commonly within the range of about 5° C. to 40° C. In the case of lubricating conduit and cable, we have found that the lubricant can be evenly distributed on the inside surface of the conduit using a variety of methods. Alternatively the lubricant can be applied to the electrical or telephone cable by hand or by automatic machines prior to installation.

After application and installation of cable and conduit, we have found that any water or hydroxy compound present in the cable lubricant compound slowly evaporates, leaving a residue comprising acrylate polyelectrolyte, fatty acid salt compound (soap) and polyacrylamide. One advantage of the invention is that the residue maintains substantial lubricating properties which can be very useful in maintenance of cable installations a while after installation is complete. Further, the evaporation of the liquids from the lubricant is slow even in environments where ambient temperature is high and in the range between 30° and 40° C. Many lubricating compositions tend to evaporate at a rate such that before installation is complete aqueous solvents have been removed by evaporation and residue of the lubricant fails to provide any substantial lubricating properties.

I have found that using the lubricant compositions of this invention surface lubricating operations are easily and economically performed. I have also found that little or no problems with respect to separation of phase changes between the components of the lubricant occur. In addition to the components which have been set forth above, the lubricant compositions of the present invention may also contain a variety of additives, agitants, dyes, colorants, perfumes, or corrosion inhibitors well known in the art. When used these additives are chemically present in amounts within the range of about 0.01 to 5 wt-% of the composition and are preferably present in amounts within the range of about 0.1 to about 3 wt-% of the composition.

The following Examples disclose the preparation of the novel lubricant compositions of the invention and include a best mode.

EXAMPLE I

Into a one liter glass beaker was placed 883.5 grams of water maintined at ambient temperature and 6.0 grams of polyacrylic acid having a molecular weight of about 4000 (CARBOPOL 940, B. F. Goodrich Co.) was slowly added. The mixture was stirred at ambient until an smooth viscous mixture was obtained. Into a separate 200 ml beaker was placed 20 milliliters of isopropyl alcohol, and 80 grams of the potassium salt of a mixture of $C_{16-20}$ fatty acid ("FLAXOAP", Sherwin-Williams Company). The mixture was agitated until the FLAXOAP was completely solubilized. Into a separate 100 ml beaker containing 10 grams of isopropanol was slowly added 3 grams of a polyacrylamide polymer (RETEN® 523, Hercules Incorporated). The mixture was stirred until a stable slurry was formed. Into the beaker containing the CARBOPOL solution was placed the FLAXOAP solution and the polyacrylamide slurry which were intimately combined with vigorous agitation until a smooth white stringy gel having a pH of about 6.5 was obtained.

EXAMPLE II

Into a one liter glass beaker was placed 500 grams of water maintained at ambient temperature and 2.5 grams of polyacrylic acid having a molecular weight of about 4000 (CARBOPOL 940, B. F. Goodrich Co.). The mixture was stirred at ambient until a smooth, viscous mixture was obtained. Into a separate 200 milliliter beaker was placed 40 grams of propylene glycol and 90 grams of the potassium salt of a mixture of $C_{16-20}$ fatty acid (FLAXOAP, Sherwin-Williams Company). The mixture was agitated until the FLAXOAP was completely solubilized. Into a separate 100 milliliter beaker containing 20 grams of propylene glycol was slowly added 5 grams of a polyacrylamide polymer (RETEN® 523, Hercules Incorporated). The mixture was stirred until a stable flurry was formed. Into the beaker containing the CARBOPOL solution was placed both the FLAXOAP solution and the polyacrylamide slurry which were intimately combined with vigorous agitation until a smooth, transparent, yellow, thickened liquid having a pH of about 7.8 was obtained.

TABLE I

Frictional Force and Coefficient of Friction at Interface of Six Inch Length Rubber Jacket Cable With Rigid Steel Conduit (2" ID)

| Lubricant | u* | 10** | 20 | 40 | 60 | 80 | 100 |
|---|---|---|---|---|---|---|---|
| Ex. I | 0.095 | 1.5 | 2.5 | 4.5 | 6.5 | 8.0 | 10.0 |
| Ex II | 0.080 | 2.0 | 3.0 | 5.0 | 6.0 | 7.0 | 8.0 |
| FLAXOAP | 0.145 | 2.5 | 4 | 5.5 | 7 | 12 | 14.5 |
| Commercial Aqueous Lub #1 | 0.135 | 1.5 | 4 | 6 | 5 | 10.5 | 13 |
| Commercial Lub #2 | 0.095 | 1.5 | 2.5 | 4 | 6 | 7.5 | 9 |
| None | 0.205 | 4 | 5.5 | 4.5 | 13 | 17 | 21 |

*u = frictional force/normal force when normal first is 100 lbs/cable foot.
** = normal force The results in Table I shows that the lubricants of this invention provide substantially equivalent lubricating properties to current commercial lubricant #2, substantially better performance than aqueous lubricant #1. Surprisingly the lubricant of the invention containing about 12% wt. FLAXOAP provides essentially equivalent performance to FLAXOAP under high loadings.

The foregoing discussion, Examples and data are illustrative of the invention. However, since many variations can be made without departing from the spirit and scope of the invention, the invention resides wholly in the claims hereinafter appended.

I claim:

1. An aqueous lubricant which comprises:

(a) a major proportion of water;

(b) an effective gelling amount of a polymeric polyelectrolyte acrylate compound having a molecular weight of at least about 1,000;

(c) an effective lubricating amount of a fatty acid salt compound; and (d) an effective lubricating amount of polyacrylamide having a molecular weight of at least about 300,000;

wherein the pH of the aqueous gel lubricant is about neutral.

2. The aqueous lubricant of claim 1 wherein the lubricant further comprises an effective antioxidant solubilizing amount of a $C_{1-6}$ alcohol.

3. The aqueous lubricant of claim 1 wherein the polymeric polyelectrolyte acrylate compound is polyacrylic acid having a molecular weight of at least about 3,000.

4. The aqueous lubricant of claim 1 wherein the fatty acid salt compound is a $C_{12-24}$ unsaturated fatty acid salt compound.

5. The aqueous lubricant of claim 3 wherein the $C_{12-24}$ unsaturated fatty acid salt compound is a potassium salt of a $C_{12-24}$ unsaturated fatty acid.

6. The aqueous lubricant of claim 1 wherein the polyacrylamide compound comprises a copolymer of acrylamide and an acrylic monomer having a pendant carboxyl group, having a molecular weight of about 300,000 to 4,000,000.

7. The aqueous lubricant of claim 2 wherein the $C_{1-6}$ alcohol is ethanol, ethylene glycol, glycerine, propylene glycol, n-hexanol, or mixtures thereof.

8. The aqueous lubricant of claim 6 wherein the $C_{1-6}$ alcohol is isopropyl alcohol, propylene glycol or mixtures thereof.

9. The aqueous lubricant of claim 1 wherein the lubricant has a pH about 6.5 to 8.0.

10. The aqueous lubricant of claim 1 which comprises:

(a) a major portion of water;

(b) the polymeric polyelectrolyte acrylate compound;

(c) about 1 to 20 parts by weight of the potassium salt of a $C_{16-20}$ fatty acid;

(d) about 0.05 to 10 parts by weight of a polyacrylamide compound;

(e) about 1 to 40 parts by weight of a $C_{1-6}$ alcohol compound;

each per part of the polymeric polyelectrolyte acrylate compound, wherein the aqueous gel lubricant has a pH of about 6.4 to 8.0.

11. A method to formulate an aqueous lubricant which comprises:

(a) forming an aqueous solution of about 0.1 to 100 parts of a polymeric polyelectrolyte acrylate compound per 1,000 parts of water;

(b) forming a solution of about 10 to 100 parts of a fatty acid compound per 10 parts of water or a $C_{1-6}$ hydroxy compound;

(c) forming a suspension of about 10 to 50 parts of a polyacrylamide per 10 parts of water or a $C_{1-6}$ alcohol; and (d) combining the aqueous solution of acrylate compound in (a), the solution of the fatty acid salt compound of (b) and the suspension of the polyacrylamide of (c) to form the aqueous gelled lubricant containing a major proportion of water, the polymeric polyelectrolyte acrylate compound, about 1 to 20 parts of the fatty acid compound, about 0.05 to 10 parts of the polyacrylamide compound and about 1 to 40 parts of alkanol each per part of the acrylate compound, wherein the aqueous lubricant has a pH about 6.5 to 8.0.

12. The method of claim 11 wherein the acrylate gelling compound is a polyacrylic acid having a molecular weight of about 4,000.

13. The method of claim 11 wherein the fatty acid compound comprises a $C_{12-24}$ unsaturated fatty acid salt compound.

14. The method of claim 13 wherein the unsaturated fatty acid salt compound comprises the potassium salt of a $C_{12-24}$ fatty acid.

15. The method of claim 11 wherein the polyalkylene oxide comprises polyacrylamide having a molecular weight of about 300,000 to 4,000,000.

16. The method of claim 11 wherein the $C_{1-6}$ hydroxy compound is ethanol, ethylene glycol, and butanol, tertiary butanol, propylene glycol, glycerol, n-hexanol, or mixtures thereof.

17. The method of claim 9 wherein the $C_{1-6}$ alcohol is isopropanol, propylene glycol or mixtures thereof.

18. An aqueous lubricant which consists essentially of:

(a) a major proportion of water;

(b) a polymer polyelectrolyte acrylate compound;

(c) about 1 to about 20 parts of the potassium salt of a $C_{12-24}$ unsaturated fatty acid;

(d) about 0.1 to about 1 part of a copolymer of acrylamide and acrylic acid, methacrylic acid or alkali metal salts thereof; and (e) 1 to 40 parts of a $C_{1-6}$ alcohol compound;

each per part of the acrylate compound, wherein the pH of the aqueous lubricant is about 6.4 to 8.0.

19. A method of lubricating the installation of cable in conduit which comprises applying the lubricant of claim 1 to the interfaces between cable and conduit during the introduction of the cable into the conduit.

20. A method of lubricating the installation of cable into conduit which comprises applying the lubricant of claim 10 to the interfaces between cable and conduit during the introduction of the cable into the conduit.

21. A method of lubricating the installation of cable into conduit which comprises applying the lubricant of claim 18 to the interfaces between cable and conduit during the introduction of the cable into the conduit.

* * * * *

UNITED STATES PATENT AND TRADEMARK OFFICE

Certificate

Patent No. 4,522,733 Patented June 11, 1985

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Nelson Jonnes and Gene Weitz.

Signed and Sealed this 2nd Day of September, 1986.

BRADLEY R. GARRIS,
*Office of the Deputy Assistant Commissioner for Patents.*